US009648964B2

(12) United States Patent
Morrow

(10) Patent No.: US 9,648,964 B2
(45) Date of Patent: May 16, 2017

(54) PLASTIC CUP DISPENSING COOLER AND METHOD OF USE

(71) Applicant: Dan L. Morrow, Littleton, CO (US)

(72) Inventor: Dan L. Morrow, Littleton, CO (US)

( * ) Notice: Subject to any disclaimer, the term of this patent is extended or adjusted under 35 U.S.C. 154(b) by 1 day.

(21) Appl. No.: 14/719,619

(22) Filed: May 22, 2015

(65) Prior Publication Data

US 2016/0338507 A1 Nov. 24, 2016

(51) Int. Cl.
*A47F 1/06* (2006.01)
*F25D 31/00* (2006.01)
*F25D 3/02* (2006.01)

(52) U.S. Cl.
CPC ..... *A47F 1/065* (2013.01); *F25D 3/02* (2013.01); *F25D 31/008* (2013.01); *F25D 2331/806* (2013.01)

(58) Field of Classification Search
CPC ..... F25D 31/008; A47F 1/065
USPC ..... 141/174; 99/275; 221/96, 221–223; 62/3.64
See application file for complete search history.

(56) References Cited

U.S. PATENT DOCUMENTS 2,923,136 A 2/1960 Tiede
3,302,427 A 2/1967 Stoner
3,349,960 A * 10/1967 Ketler ..... B67D 3/0009 221/63
3,469,739 A * 9/1969 Phillips ..... A61J 7/0046 206/217
3,587,917 A * 6/1971 Triglia ..... A47F 1/065 215/12.1
3,592,355 A * 7/1971 Manzer ..... G07F 13/10 221/104
3,949,902 A * 4/1976 Thompson ..... A47J 31/46 222/129.1
4,163,374 A 8/1979 Moore
4,243,153 A * 1/1981 Mitchell ..... B65G 1/07 221/279
4,323,172 A * 4/1982 Lim ..... A45F 3/16 220/764
4,632,274 A * 12/1986 Garbe ..... G07F 13/10 221/132

(Continued)

FOREIGN PATENT DOCUMENTS

AU 716629 3/2000
DK EP 2009377 A1 * 12/2008 ..... A47F 10/06

(Continued)

*Primary Examiner* — Timothy L Maust
(74) *Attorney, Agent, or Firm* — Leyendecker & Lemire, LLC

(57) ABSTRACT

A plastic cup dispensing cooler is described. Embodiments of the present invention include a cooler adapted to store and chill a plurality of plastic cups. The cooler can include a pair of spring-loaded cup dispensers with the dispensing end of the cup dispensers located on a top surface of the cooler. Typically, the spring-loaded cup dispensers can be located substantially within the cooler. To cool the plastic cups, the cooler can be filled with an ice and water mixture. The ice and water mixture can be implemented to chill the plastic cups to a temperature ranging from 34° F. to 40° F. Chilling the plastic cups can be implemented to limit waste created by foam formed from pouring a cold beverage into a substantially warmer cup.

20 Claims, 4 Drawing Sheets

(56) References Cited

U.S. PATENT DOCUMENTS

| | | | | |
|---|---|---|---|---|
| 4,889,261 | A * | 12/1989 | Conrad | B65D 23/12 206/499 |
| 5,301,833 | A * | 4/1994 | Aycan | A47F 1/085 206/217 |
| 5,626,353 | A * | 5/1997 | Campbell | A47B 31/02 280/47.35 |
| 5,878,593 | A | 3/1999 | Lane | |
| 7,024,882 | B2 | 4/2006 | Carmichael | |
| 7,121,112 | B2 | 10/2006 | Robertson | |
| 7,415,839 | B2 | 8/2008 | Robertson | |
| 7,458,481 | B2 | 12/2008 | Yuen | |
| 7,644,592 | B2 | 1/2010 | Kent | |
| 7,730,739 | B2 | 6/2010 | Fuchs | |
| 7,805,959 | B2 | 10/2010 | Webb | |
| 8,176,745 | B1 | 5/2012 | Korza | |
| 8,348,173 | B2 * | 1/2013 | Shin | F25D 13/06 220/592.01 |
| 8,516,849 | B2 | 8/2013 | Mooijer | |
| 8,800,795 | B2 | 8/2014 | Hwang | |
| 2003/0070447 | A1 | 4/2003 | Tanaka | |
| 2003/0164002 | A1 | 9/2003 | Coakley | |
| 2006/0196218 | A1 | 9/2006 | Mogil | |
| 2009/0056369 | A1 | 3/2009 | Fink | |
| 2009/0158770 | A1 | 6/2009 | Cohrs | |
| 2010/0199711 | A1 | 8/2010 | Smith | |
| 2011/0056232 | A1 | 3/2011 | Reese | |
| 2014/0205726 | A1 * | 7/2014 | Claesson | B67D 1/0021 426/506 |

FOREIGN PATENT DOCUMENTS

| | | |
|---|---|---|
| JP | 2002357382 | 12/2002 |
| JP | 2008286509 | 11/2008 |
| KR | 101215941 | 12/2012 |
| KR | 1020130133367 | 12/2013 |
| WO | 2009145444 | 12/2009 |

* cited by examiner

PLASTIC CUP DISPENSING COOLER AND METHOD OF USE

BACKGROUND

Plastic cups are implemented at sporting events around the world. Typically, plastic cups are used to serve beer for patrons of the sporting events. Plastic cups are ideal since they are cheap and easily disposed of. Since the plastic cups are designed to be disposed of, they typically do not include adequate insulation for keeping beer chilled.

With every cup of beer poured at a concession stand, large amounts of beer are wasted by pouring the cold beer into a warm plastic cup. The temperature difference between the cold liquid and warm plastic cup generates foam. Since foam takes time to subside, most vendors will scrape or pour the foam out to fill the beer and move along to the next customer. Further, the vendor wants to ensure a patron gets a full glass of beer so that they come back. As such, large amounts of beer are wasted over time as foam is scraped and/or poured out to keep concession lines moving.

Currently, glass mugs are chilled. However, to chill glass mugs, refrigeration means are needed to keep the glass mugs cold. While the cost to chill glass mugs may be acceptable, such a cost to keep plastic cups chilled is prohibitive. Due to the relatively low cost of plastic cups, it does not make economic sense to chill the plastic cups by refrigeration.

Therefore, there is a need for a device that economically chills plastic cups while allowing for quick dispensing of the plastic cups to keep up with demand at sporting events.

DETAILED DESCRIPTION

Figure 1:
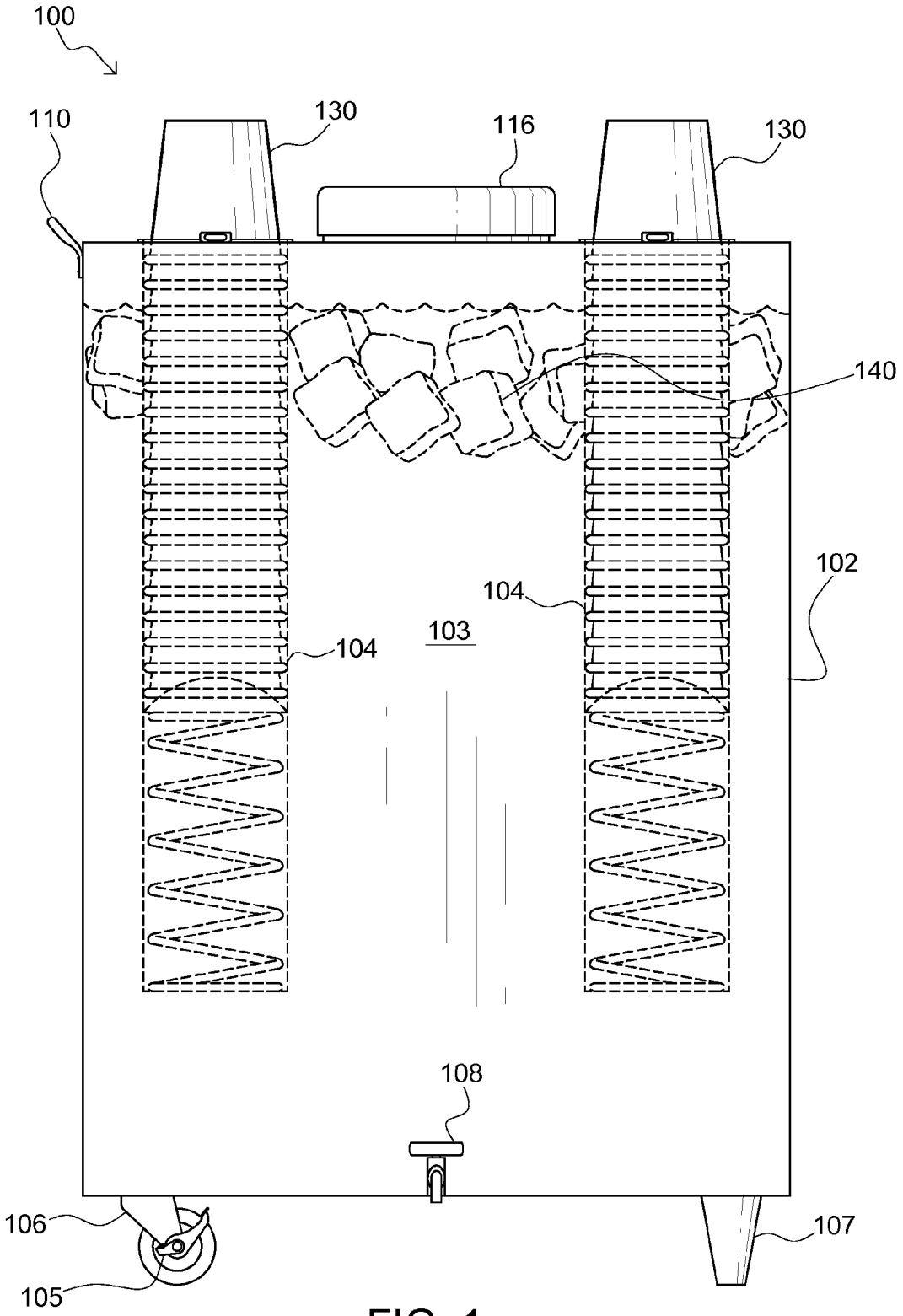
FIG. 1 is a front view of a plastic cup dispensing cooler according to one embodiment of the present invention.

Embodiments of the present invention include a plastic cup dispensing cooler. The cooler can be implemented to chill and dispense plastic cups at events. For instance, the cooler can be implemented at a ball park beer concession stand to economically chill and dispense plastic cups. The cooler can typically include an insulated container, a pair of spring-loaded cup dispensers, at least two casters, and a drain.

The pair of spring-loaded cup dispenser can be located substantially within the insulated container. A cup dispensing end of the cup dispenser can be located near a top of the insulated container. In one embodiment, plastic cups can be loaded upside down into the spring-loaded cup dispensers. For instance, a bottom end of an uppermost cup can be ready for removal from the spring-loaded cup dispensers. The rest of the cups can be generally located inside the insulated container, being chilled. Generally, the insulated container can include an opening on the top of the insulated container to allow ice and water to be poured into a cavity of the insulated container. As can be appreciated, the ice and water mixture can be implemented to chill the plastic cups located in the spring-loaded cup dispensers.

In a typical implementation, the plastic cup dispensing cooler can be placed near a liquid dispensing device. For instance, the liquid dispensing device may be a beer keg tap. In one embodiment, the cooler can be sized such that an upper surface of the cooler is approximately level with a surface of the liquid dispensing device. A vendor can then remove a chilled plastic cup from the cooler to fill with a liquid. Foaming can be reduced since a cold liquid is being poured into a chilled plastic cup. Once a plastic cup is removed, the spring-loaded cup dispenser can prepare another chilled cup to be dispensed.

Advantageously, in some embodiments the plastic cup dispensing cooler can lead to higher sales of beverages. For instance, a consumer buying a cold beverage will more likely come back to buy another beverage from the same vendor assuming the beverage they just bought stays cold during consumption of the beverage.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase’s case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “directly coupled” or “coupled directly,” as used in this specification and appended claims, refers to a physical connection between identified elements, components, or objects, in which no other element, component, or object resides between those identified as being directly coupled.

The term “approximately,” as used in this specification and appended claims, refers to plus or minus 10% of the value given.

The term “about,” as used in this specification and appended claims, refers to plus or minus 20% of the value given.

The terms “generally” and “substantially,” as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Plastic Cup Dispensing Cooler

Referring to FIG. 1, a detailed diagram of an embodiment 100 showing a plastic cup dispensing cooler is illustrated. The plastic cup dispensing cooler 100 can be implemented to chill plastic cups 130 and provide expedient dispensing of the plastic cups. Typically, the cooler 100 can be implemented at events or establishments where large amounts of beverages in plastic cups are sold.

As shown in FIG. 1, the cooler 100 can generally include a container 102 and a pair of cup dispensers 104. A cavity 103 can be formed in the interior of the container 102. The pair of cup dispensers 104 can be located substantially within the cavity 103 of the container 102. For instance, an upper portion of the cup dispensers 104 can be located outside the cavity 103 of the container 102.

The container 102 can generally include, but is not limited to, at least two castors 106, a drain 108, and a handle 110. In one embodiment, the container 102 can be hollow and have insulated walls. For instance, the container 102 can be manufactured from stainless steel with an insulating material located between sheets of stainless steel. In one embodiment, the container 102 can have a rectangular shape, as shown in FIG. 1. Where the container 102 is rectangular, the container 102 can be defined by a bottom, a pair of sidewalls, a front wall, a back wall, and a top. It is to be appreciated that different shapes are contemplated for the container 102.

The front wall of the container 102 can typically include the drain 108. The at least two casters 106 can generally be coupled to the bottom of the container 102. The handle 110 can typically be coupled to one of the sidewalls of the container 102.

In one embodiment, the casters 106 can each include a locking mechanism 105. The locking mechanism 105 can be implemented to keep wheels of the casters 106 from moving. For instance, after the cooler 100 has been moved to a place of implementation, the locking mechanisms 105 can be engaged to keep the cooler 100 from moving.

The cooler 100 can include the drain 108 to release liquid from the container 102. Generally, the drain 108 can be fluidly connected to the container 102 to release fluids when open. The drain 108 can include, but is not limited to, a ball valve, a spigot, a hole with rubber plug, a water dispenser valve, etc. The drain 108 can be closed when the cooler 100 is being used. When the cooler 100 is no longer being used, water inside the cavity 103 of the container 102 can be drained from the cooler 100 through the drain 108. In one embodiment, the bottom of the container 102 can be tapered towards the drain 108 to more efficiently drain water in the cavity 103.

Generally, the cooler 100 can include the handle 110 to help move the cooler 100. In one embodiment, the handle 110 can be located on a side of the cooler 100 having the at least two casters 106.

Figure 2:
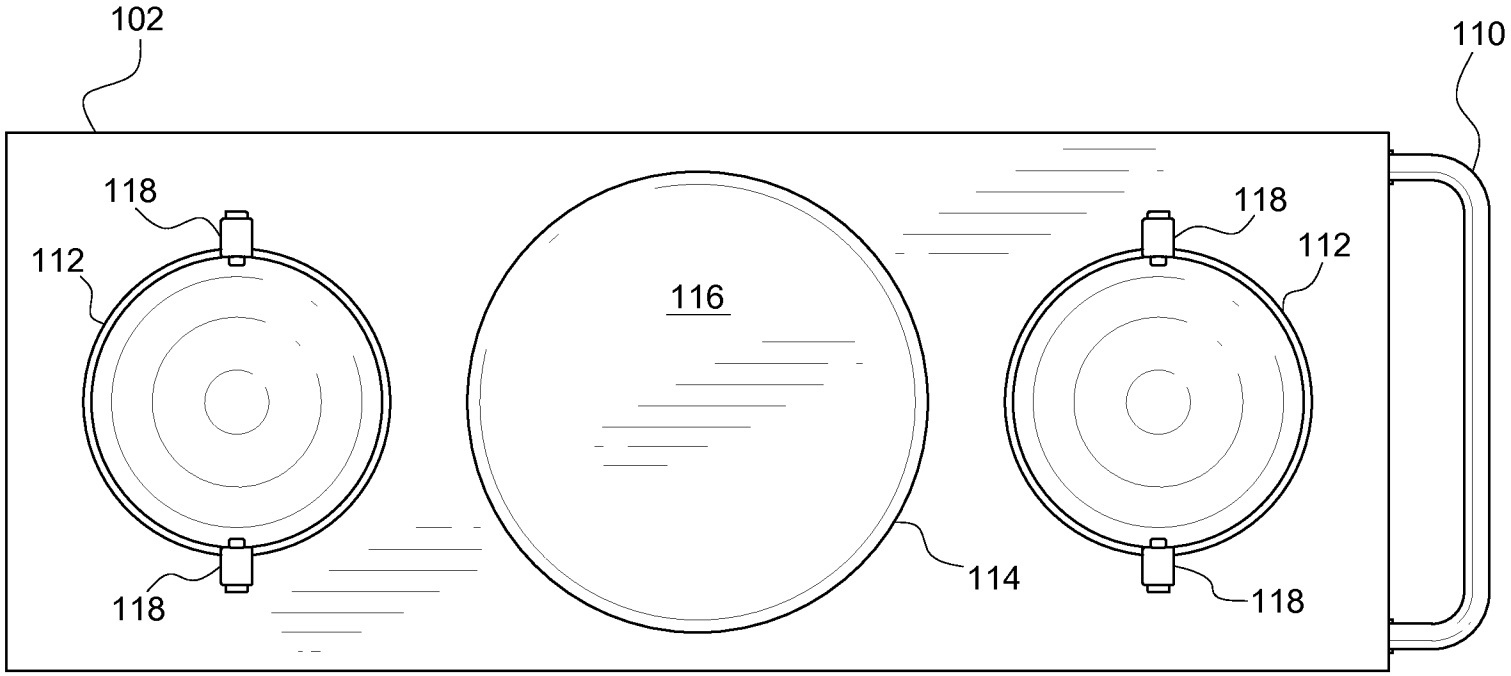
FIG. 2 is a top view of a plastic cup dispensing cooler according to one embodiment of the present invention.

Referring to FIG. 2, a detailed diagram of a top of the cooler 100 is illustrated. As shown, the top of the container 102 can include a pair of openings 112 for receiving the pair of cup dispensers 104 and an opening 114 for inputting ice and/or water into the cavity 103. Generally, the cavity opening 114 can include a lid 116 that is threadably coupled to the cavity opening 114. In one embodiment, the lid 116 can be friction fit to the cavity opening 114. For instance, an o-ring can be implemented to friction fit the lid 116 to the cavity opening 114. It is to be appreciated that other means of coupling the lid 116 to the cavity opening 114 are contemplated.

As shown, the pair of dispenser openings 112 can each include one or more locking structures 118. For instance, the locking structures 118 can be clasps. The clasps 118 can be implemented to lock the spring-loaded cup dispensers 104 inside the container 102. Generally, one or more types of cup dispensers can be implemented with the cooler 100. The cooler 100 can be adapted to implement a variety of differently sized cup dispensers allowing for the cooler 100 to be used at different venues and for different products. For instance, the cooler 100 may implement cup dispensers for 16 oz. sized plastic cups at a beer stand and may implement cup dispensers for 44 oz. sized plastic cups at a soda pop stand. In some instances, the clasps 118 can allow for quick replacement of the cup dispensers.

Generally, the pair of dispenser openings 112 can be located on the top of the container 102 such that when the cavity 103 is filled with an ice and water mixture 140, the spring-loaded cup dispensers 104 can be substantially surrounded by the ice and water mixture 140. By increasing a surface area of the spring-loaded cup dispensers 104 adapted to be in contact with the ice and water mixture 140, the plastic cups 130 can be chilled at a maximum rate. For instance, heat from the plastic cups 130 can be dissipated faster to heat the ice and water mixture 140, thus chilling the plastic cups 130.

Figure 3:
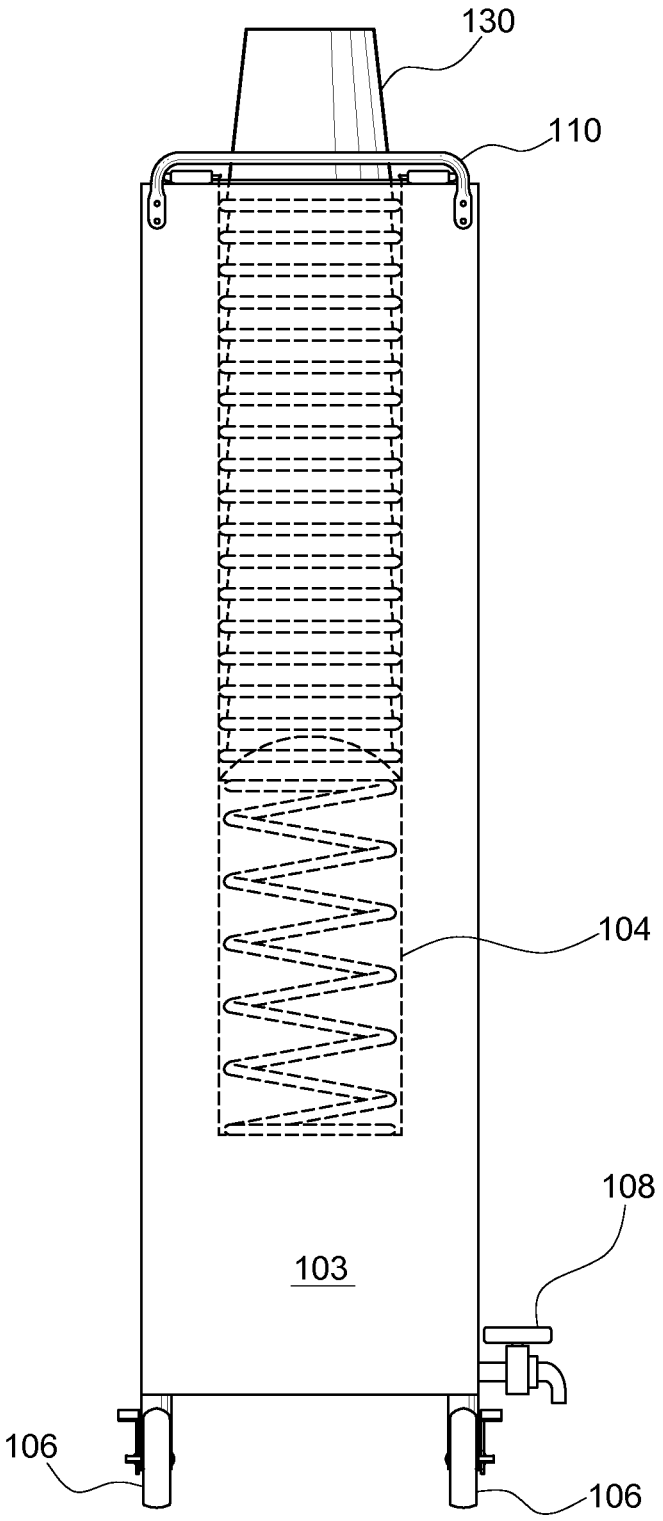
FIG. 3 is a side view of a plastic cup dispensing cooler according to one embodiment of the present invention.

Referring to FIG. 3, a side view of the cooler 102 is illustrated. One of the cup dispensers 104 is shown in the cavity 103 of the container 102. As shown, the cooler 100 can be relatively narrow at approximately 7 inches deep. The cooler 100 can be adapted to have a small footprint to take up as minimal space as possible. Typically, the cooler 100 can include four casters. In embodiments implementing only two casters 106, the other end of the cooler 100 can include a pair of legs 107 having a height substantially similar to the pair of casters 106, as shown in FIG. 1. Typically, the pair of legs 107 can be located on the opposite side of the cooler 100 having the handle 110. The pair of casters 106 can typically be located on the side of the cooler 100 having the handle 110.

An Example Embodiment of Plastic Cup Dispensing Cooler

In an example embodiment of the cooler 100, the container 102 can measure approximately 39½ inches long, 18 inches wide, and 7 inches deep. More specifically, the front wall and the back wall can each measure approximately 39½ inches by 18 inches. The pair of sidewalls can each measure approximately 39½ inches by 7 inches. The bottom and the top can each me asure approximately 18 inches by 7 inches. The casters 106 can be 2½ inches high giving the cooler 100 an overall height of 42 inches. It is to be appreciated that a height of the container 102 and the casters 106 can be altered such that the cooler 100 maintains an overall height of 42 inches.

Each of the components of the container 102 can be directly coupled together. In an exemplary embodiment, the walls of the container 102 can be welded together to prevent leakage. In one example, the container 102 can be manufactured from stainless steel. In another example, the container 102 can be manufactured from aluminum. In another example, the cooler 100 can be manufactured from more than one material. The bottom, the pair of sidewalls, the front wall, the back wall, and the top of the container 102 can each be insulated. For instance, the container 102 can include a layer of STYROFOAM® to insulate the cooler 100. It is to be appreciated that other materials can be implemented to insulate the container 102 without exceeding a scope of the present invention.

In a typical implementation, the pair of cup dispensers 104 can be sized to fit 50 cups each. For instance, the cooler 100 can be adapted to chill 100 plastic cups at a time. Generally, each of the pair of cup dispensers 104 can be spring-loaded and dispense the cups bottom end up. In one embodiment, a cup dispenser as described in U.S. Publication No. 2007/0295746, filed Nov. 2, 2006, titled "Cup dispenser" can be implemented with the cooler 100. U.S. Publication No. 2007/0295746, filed Nov. 2, 2006, and titled "Cup dispenser" is herein incorporated by reference in its entirety. The pair of cup dispensers 104 can be manufactured from a poor insulating material including, but not limited to, steel, stainless steel, and aluminum. The pair of cup dispensers 104 can be manufactured from a poor insulating material so that the plastic cups can be chilled as quickly as possible without being in direct contact with the ice and water mixture 140.

The top of the container 102 can include the dispenser openings 112 and the cavity opening 114. As shown in FIG. 2, the pair of dispenser openings 112 can generally be located on either side of the cavity opening 114. Each of the dispenser openings 112 can have a substantially circular cross-section with an approximately 4 inch diameter. The cavity opening 114 can have a substantially circular cross-section with an approximately 6 inch diameter. Typically, the cavity opening 114 can be larger than the dispenser openings 112 to allow easy access to the cavity 103 of the cooler 100.

The example embodiment of the cooler 100 can include 4 casters. The casters 106 can be located on each corner of the bottom of the container 102. The casters 106 can include 2 inch diameter wheels and have a total height of 2½ inches. Generally, the casters 106 can be swivel casters adapted to rotate 360 degrees and include a locking mechanism. The locking mechanism can be implemented to keep the wheels from rotating. An attachment plate of the casters 106 can be made from steel and the wheels can be manufactured from rubber.

The front wall of the container 102 can include the drain 108 located approximately near a bottom central portion of the front wall. In the example embodiment, the drain 108 can be a spigot. The drain 108 can be fluidly connected to the container 102 to release fluids when open.

One end of the cooler 100 can include the handle 110. Generally, the handle 110 can be manufactured from the same material as the container 102. For instance, the handle 110 can be manufactured from stainless steel. In one example, the handle 110 can be manufactured from a different material than the container 102. The handle 110 can typically measure between approximately 5 inches to 7 inches. Typically, the handle 110 can be directly coupled to the container 102. In one example, the handle 110 can be welded to the container 102.

An Example Method of Implementing a Plastic Cup Dispensing Cooler

Figure 4:
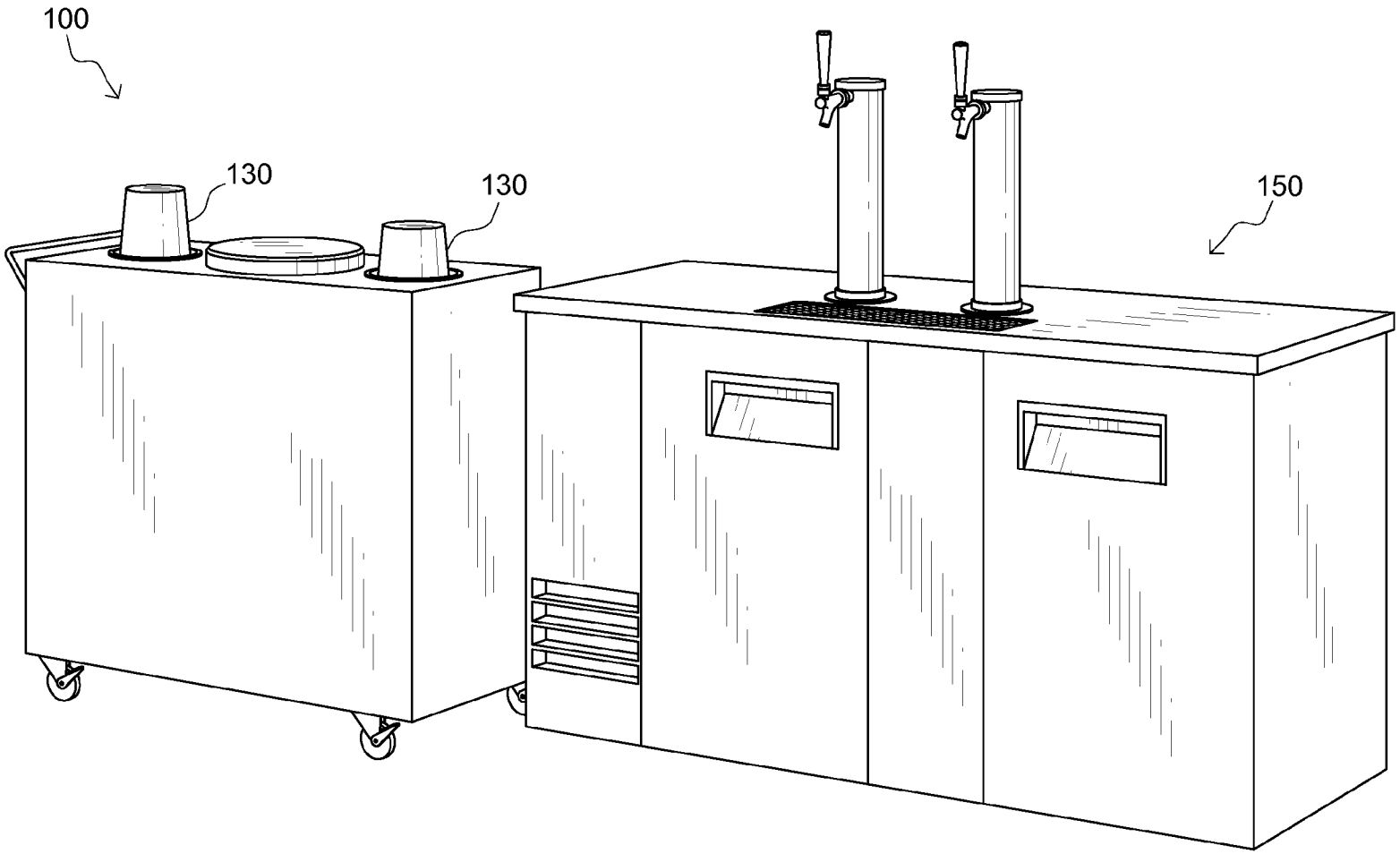
FIG. 4 is a perspective view of a plastic cup dispensing cooler in combination with a beer dispenser according to one embodiment of the present invention.

Referring to FIG. 4, the plastic cup dispensing cooler 100 is shown with a beer dispenser 150. In an example method of implementing the plastic cup dispensing cooler 100, the cooler 100 can typically be implemented at an event or venue where adult beverages are sold. It is to be appreciated that the cooler 100 can be implemented in a variety of locations and situations where plastic cups are used to sell beverages. Generally, the cooler 100 can be implemented with a carbonated beverage including, but not limited to, beer, soda pop, carbonated water, etc.

In a first step, the cooler 100 can be transported to a venue and setup next to a beverage dispensing device 150. For instance, the cooler 100 can be setup next to a beer keg dispensing machine. Typically, the cooler 100 can be sized such that a top of the cooler 100 will be level with a counter of the beverage dispensing device 150.

In a second step, the spring-loaded cup dispensers 104 can be filled to capacity with plastic cups 130. Depending on the type of beverage and beverage size being offered, the spring-loaded cup dispensers 104 can be filled with proper sized cups.

In a third step, the lid 116 can be removed from the cavity opening 114 and water and/or ice can be poured into the cavity 103 of the cooler 100. Generally, the container 102 can be filled to near capacity to chill the plastic cups in the spring-loaded cup dispensers 104. Depending on a temperature at the event, the plastic cups 130 can be allowed to chill for at least 20 minutes. Generally, the cups 130 can be chilled until they reach a temperature of at least 40° F. In a preferred example, the plastic cups 130 can be chilled to a temperature between 32° F. to 36° F.

In a fourth step, a plastic cup 130 can be removed from one of the spring-loaded cup dispensers 104 and filled with a cold beverage. By implementing the chilled plastic cup with the cold beverage, less foam is formed. Typically, a vendor can anticipate saving approximately 10% to 30% of the beverage previously loss to the beverage foaming. In one embodiment, a vendor can expect to save between approximately 15% to 25%.

The vendor can continue to remove plastic cups until both of the spring-loaded cup dispensers 104 have been emptied. Once the spring-loaded cup dispensers are empty, the vendor can refill them if needed.

In a fifth step, after the sale of beverages has ended, the vendor can use the drain 108 to remove any liquid from the cavity 103 of the cooler 100. The drain 108 can typically be left open to allow the cavity 103 to dry. It is to be appreciated that the drain 108 can be closed after most of the liquid has egressed from the cavity 103.

Generally, the casters 106 can be implemented to transport the cooler 100 from place to place. The locking mechanisms of the casters 106 can be engaged to lock the wheels when the cooler 100 is being used.

In some embodiments, a vendor implementing the plastic cup dispensing cooler 100 can use the cooler 100 to keep track of an amount of beverages sold. For instance, since the cooler 100 holds a predetermined number of cups, the vendor can count any remaining cups to determine how many beverages were sold. In some embodiments, the cooler 100 can be implemented to determine if the number of beverages sold match up with the number of cups left in the cooler 100. For instance, an employer may determine if an amount of money left in the register matches with the number of beverages sold.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A plastic cup dispensing cooler for chilling plastic cups, the plastic cup dispensing cooler comprising:

a container having a cavity adapted to be filled with ice, the container being defined by:

a bottom having a substantially rectangular shape with a width of approximately 7 inches and a length of approximately 18 inches;

a top having a substantially rectangular shape with a width of approximately 7 inches and a length of approximately 18 inches;

a front wall having a substantially rectangular shape with a width of approximately 18 inches and a length of approximately 39 and a ½ inches;

a back wall having a substantially rectangular shape with a width of approximately 18 inches and a length of approximately 39 and a ½ inches; and a pair of sidewalls each having a substantially rectangular shape with a width of approximately 7 inches and a length of approximately 39 and a ½ inches;

a pair of spring-loaded cup dispensers located substantially within the cavity of the container, the pair of spring-loaded cup dispensers adapted to be substantially surrounded by ice and manufactured from a poor insulating material selected from the group consisting of stainless steel, steel, and aluminum;

a first opening and a second opening located on the top of the container, the first opening and the second opening each adapted to receive one of the pair of spring-loaded cup dispensers;

a third opening located on the top of the container and having a lid, wherein the third opening is located between the first opening and the second opening;

at least two casters coupled to the bottom of the container; and a drain located on the front wall and proximate the bottom of the container.

2. The plastic cup dispensing cooler of claim 1, wherein a cup dispensing end of each of the pair of spring-loaded cup dispensers is located proximate the top of the container.

3. The plastic cup dispensing cooler of claim 1, wherein each of the pair of spring-loaded cup dispensers holds approximately 50 plastic cups.

4. The plastic cup dispensing cooler of claim 1, wherein the pair of spring-loaded cup dispensers are removably inserted into the first opening and the second opening.

5. The plastic cup dispensing cooler of claim 1, wherein the third opening provides access to the cavity.

6. The plastic cup dispensing cooler of claim 1, wherein the cooler further includes a handle coupled to a top portion of one of the sidewalls of the container.

7. The plastic cup dispensing cooler of claim 1, wherein the bottom of the container is tapered towards the drain.

8. The plastic cup dispensing cooler of claim 1, wherein the container is insulated.

9. The plastic cup dispensing cooler of claim 1, wherein the cavity of the container is filled with an ice and water mixture.

10. The plastic cup dispensing cooler of claim 9, wherein one or more cups loaded into one of the spring-loaded cup dispensers is chilled by the ice and water mixture.

11. The plastic cup dispensing cooler of claim 1, wherein the cooler chills one or more cups loaded into the spring-loaded cup dispensers to at least 40° F.

12. A method of using the plastic cup dispensing cooler of claim 1, the method comprising:

filling each of the pair of spring-loaded cup dispensers with plastic cups;

removing the lid from the third opening;

filling the container with an ice and water mixture;

chilling the plastic cups until the plastic cups reach a temperature of at least 40° F.;

removing a chilled plastic cup from one of the spring-loaded dispensers; and filling the chilled plastic cup with a chilled beverage.

13. The method of claim 12, wherein each of the spring-loaded cup dispensers are loaded with approximately 50 plastic cups.

14. The method of claim 12, wherein the plastic cups are chilled until they reach a temperature of at least 35° F.

15. A plastic cup dispensing cooler system comprising:

a container including:

a pair of spring-loaded cup dispensers each adapted to hold a plurality of plastic cups, the pair of spring-loaded cup dispensers located substantially within the container;

a first opening and a second opening located on a top surface of the container, the first opening and the second opening each adapted to receive one of the pair of spring-loaded cup dispensers;

a third opening located on the top surface of the container and having a lid, the third opening being located between the first opening and the second opening;

four casters, wherein at least two of the casters include a locking mechanism; and a drain located near a bottom of the container;

an ice and water mixture adapted to be inserted inside the container; and a plurality of plastic cups adapted to be loaded into each of the pair of spring-loaded cup dispensers;

wherein the first opening and the second opening each have a substantially circular cross-section with an approximately 4 inch diameter;

wherein the third opening has a substantially circular cross-section with an approximately 6 inch diameter.

16. The plastic cup dispensing cooler system of claim 15, wherein a cup dispensing end of each of the pair of spring-loaded cup dispensers is located proximate a top of the container.

17. The plastic cup dispensing cooler system of claim 15, wherein the bottom of the container is tapered towards the drain.

18. The plastic cup dispensing cooler system of claim 15, wherein one or more cups loaded into one of the spring-loaded cup dispensers is chilled by the ice and water mixture to a temperature of at least 40° F.

19. The plastic cup dispensing cooler system of claim 15, wherein the container is insulated.

20. A method for implementing a cup dispensing cooler, the method comprising:

providing a cup dispensing cooler including:

a container, the container being defined by:

a bottom having a substantially rectangular shape;

a top having a substantially rectangular shape;

a front wall having a substantially rectangular shape;

a back wall having a substantially rectangular shape; and a pair of sidewalls each having a substantially rectangular shape;

a pair of spring-loaded cup dispensers each adapted to hold a plurality of plastic cups, the pair of spring-loaded cup dispensers located substantially within the container and manufactured from a poor insulating material selected from the group consisting of stainless steel, steel, and aluminum;

a first opening and a second opening located on a top surface of the container, the first opening and the second opening each adapted to receive one of the pair of spring-loaded cup dispensers;

a third opening located on a top surface of the container and having a lid, the third opening being located between the first opening and the second opening;

four casters, wherein at least two of the casters include a locking mechanism; and a drain located near a bottom of the container;

filling each of the pair of spring-loaded cup dispensers with plastic cups;

filling the container with an ice and water mixture;

chilling the plastic cups until the plastic cups reach a temperature of at least 40° F.;

removing a chilled plastic cup from one of the spring-loaded dispensers; and filling the chilled plastic cup with a chilled beverage.

* * * * *